US005692744A

United States Patent [19]

Funato

[11] Patent Number: 5,692,744

[45] Date of Patent: Dec. 2, 1997

[54] PAPER FEEDER

[75] Inventor: Hitoshi Funato, Ebina, Japan

[73] Assignee: Fuji Xerox Co., Ltd., Tokyo, Japan

[21] Appl. No.: 442,054

[22] Filed: May 16, 1995

[30] Foreign Application Priority Data

May 16, 1994 [JP] Japan ..... 6-124668

[51] Int. Cl.[6] ..... B65H 9/04

[52] U.S. Cl. ..... 271/242; 271/272

[58] Field of Search ..... 271/242, 245, 271/246, 272

[56] References Cited

FOREIGN PATENT DOCUMENTS

| | | | |
|---|---|---|---|
| 57-70563 | 5/1982 | Japan . | |
| 61-197344 | 9/1986 | Japan | 271/242 |
| 62-185653 | 8/1987 | Japan | 271/242 |
| 63-67552 | 5/1988 | Japan . | |
| 4-18303 | 3/1992 | Japan . | |
| 4260551 | 9/1992 | Japan | 271/242 |
| 6100208 | 4/1994 | Japan | 271/242 |
| 6191686 | 7/1994 | Japan | 271/242 |

*Primary Examiner*—David H. Bollinger
*Attorney, Agent, or Firm*—Finnegan, Henderson, Farabow, Garrett & Dunner, L.L.P.

[57] ABSTRACT

A paper feeder is suitable for use in an image forming apparatus such as a copier, a printer or the like and is capable of suitably correcting the direction of a sheet of paper conveyed from a registration device to a transfer unit. A paper conveying path is provided in curve form between a resist roller pair and a conveying roller pair provided on the upstream side of the resist roller pair as seen in a paper feeding direction. A fixed guide member is provided on the concave side of the paper conveying path. A movable guide member rotatably supported by a rotatable shaft with the rotatable shaft taken as the center, is provided on the convex side of the paper conveying path. The movable guide member is urged toward the fixed guide member by a torsion spring. A film-shaped elastic member which extends toward the downstream side as seen in the paper conveying direction, is mounted on a leading end portion of the movable guide member. Thus, a force for pressing the leading end portion of the paper against the resist roller pair suitably acts on the paper so that the oblique feeding of the paper is reliably corrected.

4 Claims, 4 Drawing Sheets

PAPER FEEDER

BACKGROUND OF THE INVENTION

1. Field of the Invention

The present invention relates to a paper feeder which is suitable for use in an image forming apparatus such as a copier or a printer to which an electrophotographic process is applied, and which is capable of successively one by one feeding sheets of paper on which images are transferred and fixed.

2. Description of the Related Art

An image forming apparatus such as a copier or a printer is provided with a paper feeder for successively one by one conveying sheets of paper held in a paper tray to a transfer unit, feeding the paper with a toner image transferred thereon to a fixing unit and delivering it to a paper delivery or take-off device. The paper feeder has guide members for controlling a paper conveying path on both sides of the paper conveying path and a plurality of conveying roller pairs opposed to and brought into contact with the paper conveying path. The paper feeder feeds the paper in a predetermined direction under the rotation of each conveying roller pair.

In this type of paper feeder, the paper must be conveyed to the transfer unit in predetermined timing while suitably maintaining the direction of the paper with the image transferred thereon. However, when the sheets of paper stacked on each other within the paper tray are taken out one by one or the paper is being fed by the conveying roller pair, the direction of each paper is made oblique and the paper is often fed along the paper conveying path as it is.

The following paper feeder is known as the paper feeder for correcting the direction of each diagonally-fed paper. In this type of paper feeder, a leading end portion of a sheet of paper is brought into contact with a member for closing a paper conveying path, e.g., a resist roller pair so as to temporarily stop moving. Further, a rear portion of the paper is fed out even after the leading end portion of the paper has stopped moving, so that the paper is brought to a bent shape. Since, at this time, the rear portion of the paper is being retrained by the corresponding conveying roller pair, the paper direction is corrected in the direction of a nip between the resist roller pair by a restoring force of the paper even if the leading end portion of the paper is placed in the oblique state, thereby correcting the oblique feeding of the paper.

In this type of paper feeder, however, a large space is defined between the guide members opposed to each other on the upstream side of the resist roller pair as seen in the paper feeding direction, taking into consideration the amount of deflection of the paper, so that the paper is incompletely guided. When a sheet of paper that lacks firmness or is limp, such as paper thin in thickness is used, the direction of traveling of the paper is made unstable within the large space and the leading end portion of the paper accurately no longer enters the nip between the resist roller pair. Therefore, an advantageous effect for correcting the oblique feeding of the paper is greatly reduced and inconvenience is developed that the transfer position of the image is displaced when the paper is fed to the transfer unit.

To avoid such inconvenience, paper feeders disclosed in Japanese Patent Laid-Open No. Sho 57(1982)-70563, Japanese Utility Model Laid-Open No. Sho 63(1988)-67552 and Japanese Patent Publication No. Hei 4(1992)-18303 have been proposed.

In the paper feeder disclosed in Japanese Patent Laid-Open No. Sho 57(1982)-70563, an elastic member for pressing a sheet of paper entered into a nip between a resist roller pair in the direction of the nip is provided on the upstream side of the resist roller pair, which extends in a paper conveying direction.

In the paper feeder disclosed in Japanese Utility Model Laid-Open No. Sho 63(1988)-67552, a pair of guide plates is provided on the upstream side of a resist roller pair and the guide plate pair is swingably supported so as to form a curved or bent conveying path according to the amount of deflection of paper.

In the paper feeder disclosed in Japanese Patent Publication No. Hei 4(1992)-18303, a guide member is supported so as to be swingably displaced according to the nerve of paper. Buckling deformation is applied to the paper based on such a displacement.

However, the aforementioned paper feeders involve the following problems.

In the paper feeder disclosed in Japanese Patent Laid-Open No. Sho 57(1982)-70563, the elastic member is used to press the paper in the direction of the nip between the resist roller pair. However, such an elastic member cannot guide the paper with high accuracy and the direction of feeding the paper cannot be stabilized in the case of limp paper or the like. Namely, a problem arises that even if a bent surface of the paper is pressed by the elastic member, the direction of the paper cannot be suitably corrected. Further, since a phenomenon that the leading end portion of the paper is greatly swung between guide members takes place, a problem arises that the time required for the paper to reach the resist roller pair varies.

The paper feeder disclosed in Japanese Utility Model Laid-Open No. Sho 63(1988)-67552 has a problem that since the pair of guide members is swung, a mechanism of the paper feeder becomes complicated. When a sheet of limp paper is fed, a force for swinging the guide member pair becomes weak. It is also impossible to swing the guide member pair so as to form a suitable bent conveying path. Therefore, there is a possibility that the performance of correcting the oblique feeding of the paper is impaired according to the type of paper.

In the paper feeder disclosed in Japanese Patent Publication No. Hei 4(1992)-18303, the angle of each guide plate can be changed and the amount of paper deflection that is developed due to paper bending can be adjusted. However, the instability of the feeding of paper within a space cannot be corrected. Further, since the oblique feeding of the paper is corrected by a repulsive force of the curved paper alone, there is a case in which a correcting force is insufficient.

SUMMARY OF THE INVENTION

With the forgoing problems in view, it is an object of the present invention to provide a paper feeder capable of suitably correcting the direction of paper fed from a resist roller pair to a transfer unit regardless of the type of paper and of providing satisfactory alignment at the transfer unit.

According to one aspect of this invention, for achieving the above object, there is provided a paper feeder comprising a pair of guide members provided on both sides of a paper conveying path so as to be opposed to and separated from each other and for controlling the paper conveying path; a pair of conveying rollers opposed to and brought into contact with each other within the paper conveying path and for feeding a sheet of paper held therebetween by rotatably driving the conveying roller pair; a registration device provided on the downstream side of a position where the conveying roller pair in the paper conveying path is provided and for bringing a leading end portion of the paper into contact therewith so as to temporarily stop moving and resuming moving the leading end portion thereof in predetermined timing; the conveying roller pair and the registration device being disposed such that the direction of feeding the paper by the conveying roller pair and the direction in which the paper enters the registration device respectively have angles; a fixed guide member provided on the convex side of the paper conveying path bent between the conveying roller pair and the registration device; a movable guide member opposed to and separated from the fixed guide member on the convex side of the paper conveying path, rotatably supported in the neighborhood of an end thereof on the upstream side as seen in the paper conveying direction and supported so as to be able to be withdrawn from the position opposed to the fixed guide member; urging means for urging the movable guide member toward the fixed guide member; and a film-like elastic member which extends from a leading end portion of the movable guide member to the downstream side extending in the paper conveying direction.

In the above paper feeder, the film-like elastic member is constructed in such a manner that at least a leading end portion thereof is divided into a plurality of parts by cutting plane lines extending in a paper conveying direction.

In the paper feeder, if the movable guide member is withdrawably supported with the downstream side extending in the paper conveying direction as a fulcrum when the paper is bent between the fixed guide member and the movable guide member, a supported structure can be suitably set. Further, the urging means for urging the movable guide member toward the fixed guide member may preferably provide an urging force set to suitable strength in such a manner that the position where the movable guide member is withdrawn subtly varies according to the nerve of the paper.

It is desirable that the film-like elastic member is formed of a material capable of being flexibly deformed by pressure under which the film-like elastic member contacts the paper and is set so as to have a suitable length extending in the paper conveying direction.

In the film-like elastic member employed in the paper feeder, the divided parts are respectively independently supported so as to be deformable by the pressure under which the film-like elastic member contacts the paper, and the shapes, dimensions and the like of the divided parts can be suitably set. It is also desirable that the number of the divided parts extending in the transverse direction (i.e., in the direction orthogonal to the paper conveying direction) is suitably set in such a manner that the urging force can be transferred on a substantially uniform basis even if the amount of deflection of the paper varies in transverse direction.

In the paper feeder, the paper is fed between the opposed and separated guide members along these guide members and the leading end portion of the paper is brought into contact with the registration device so as to temporarily stop moving. Thereafter, the conveying roller pair holding the rear portion of the paper therebetween continues to rotate for a predetermined time. Further, paper having a length longer than that of the paper conveying path is fed between the registration device and the conveying roller pair. Since, at this time, the paper conveying path between the conveying roller pair and the registration device is bent and the movable guide member provided on the convex side of the paper conveying path is withdrawably supported, the movable guide member is pressed by the force that extends toward the convex side of the bent paper so as to be withdrawn from the paper conveying path. Since the movable guide member is urged toward the concave side of the paper conveying path by the urging means, the force in the direction of pressing the convex surface of the paper acts on the paper from the movable guide member. This force acts as an in-plane force applied in the paper conveying direction. When the leading end portion of the paper obliquely contacts the registration device, this force acts as a force for correcting the oblique feeding of the paper.

Further, the film-like elastic member that extends toward the downstream side, is mounted to the movable guide member. When the movable guide member is provided such that the film-like elastic member is brought into contact with the convex portion of the curved paper, the film-like elastic member is flexibly deformed by the pressure under which the paper contacts the film-like elastic member, so that the movable guide member is retreated from the paper conveying path. Thus, the urged movable guide member and the film-like elastic member are displaced and deformed according to the amount of deflection of the bent paper to thereby apply a force to be supplied to the registration device to the paper. Therefore, even if the rigidity of the paper varies, e.g., a sheet of soft paper is used, a suitable amount of deflection and an in-plane force are applied to the paper so that the oblique feeding of the paper is corrected. Since the upstream side of the film-like elastic member is supported by the movable guide member and the downstream side thereof is withdrawn, the surface thereof that contacts the paper is placed in the direction of feeding the paper to the registration device, thereby making it possible to effectively force out the paper toward the registration device. As a result, the paper is brought into contact with the film-like elastic member in a state in which a sufficient amount of deflection is being held on the downstream side, so as to be forced out toward the registration device. The resulting force makes it possible to more reliably correct the oblique feeding of the paper.

Namely, owing to the above structure, the movable guide member can be accurately withdrawn over a wide range and the in-plane force in the paper conveying direction is reliably applied to the paper so as to be adapted to the rigidity of the paper. In conjunction with this, the sufficient amount of deflection of the paper due to its bending is ensured on the downstream side of the paper and the force can be applied to the registration device in a state in which the leading end portion of the paper is easy to freely move, thereby making it possible to reliably correct the oblique feeding of the paper.

In the paper feeder, the leading end portion of the film-like elastic member is divided into the plurality of parts by the cutting plane lines extending in the paper conveying direction under the structure as defined in Claim 1. Therefore, even if the amount of deflection at the time that the paper is obliquely conveyed and bent, varies in transverse direction (i.e., in the. direction orthogonal to the paper conveying direction), the transversely-divided parts of film-like elastic member are respectively independently brought into contact with the paper so as to transfer the urging force to the paper. Thus, the in-plane force can be substantially uniformly applied to the registration device along the transverse direction so that the oblique feeding of the paper can be reliably corrected.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENT

A preferred embodiment of the present invention will hereinafter be described in detail with reference to the accompanying drawings.

Figure 1:
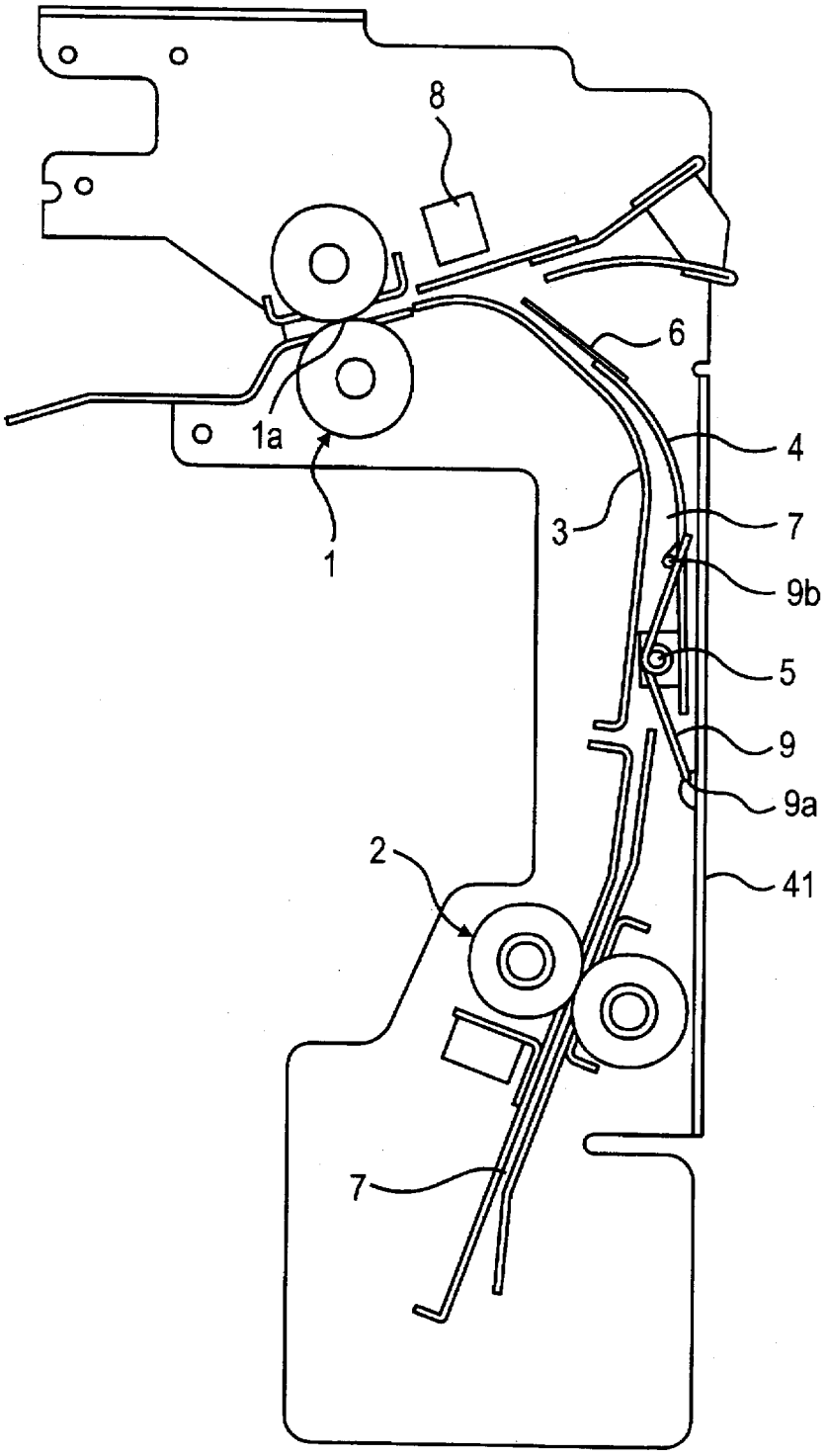
FIG. 1 is a view schematically showing the structure of a paper feeder in one embodiment according to the present invention.
Figure 2:
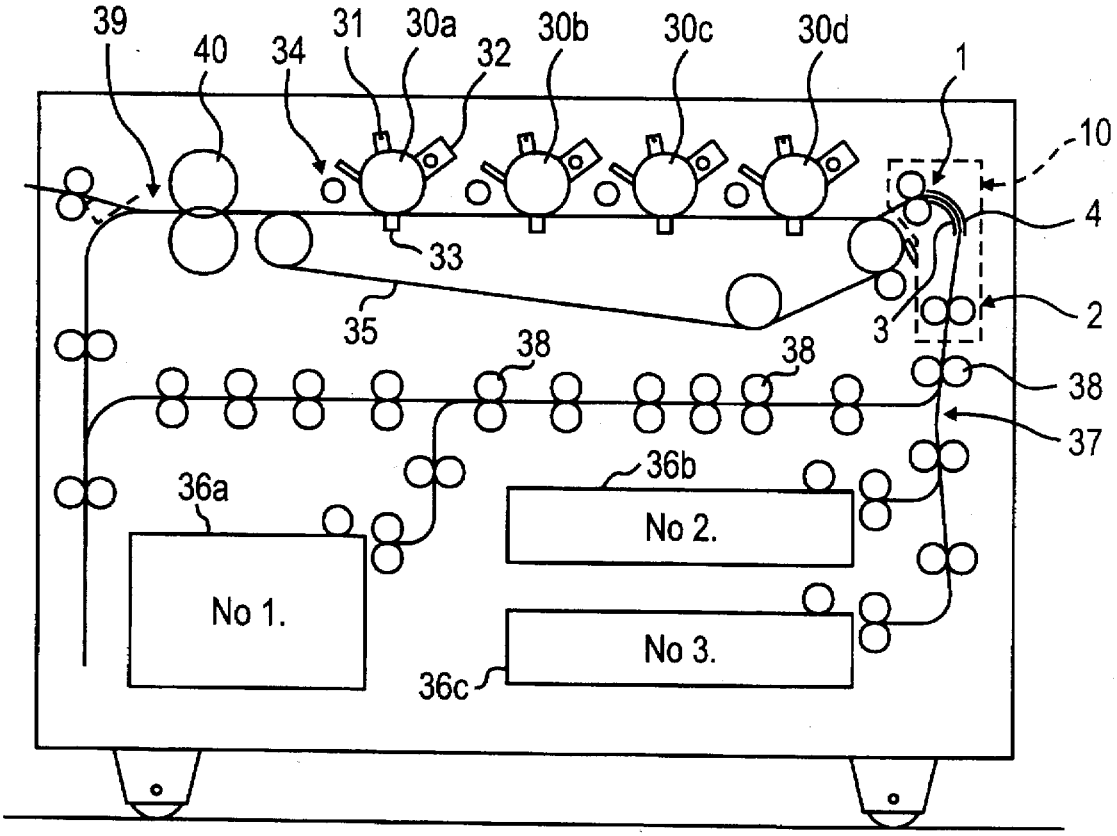
FIG. 2 is a view schematically showing the structure of an image forming apparatus in which the paper feeder shown in FIG. 1 is employed.

FIG. 1 is a view schematically showing the structure of a principal part of a paper feeder in one embodiment according to the present invention. FIG. 2 is a view schematically illustrating the structure of an image forming apparatus to which the paper feeder shown in FIG. 1 is applied.

In FIG. 2, the image forming apparatus has a transfer belt 35 capable of electrostatically applying a sheet of paper thereon and feeding the same and four photosensitive drums 30*a*, 30*b*, 30*c* and 30*d* (30) disposed in the position opposed to the transfer belt 35. Each of the photosensitive drums 30*a*, 30*b*, 30*c* and 30*d* is provided therearound with a transfer device 31 for uniformly charging the surface of each photosensitive drum, a developer unit 32 for applying toner on a latent image formed on each photosensitive drum and making it visible, a transfer device 33 for transferring a toner image formed on each photosensitive drum onto the paper, and a cleaning device 34 for cleaning toner left on each photosensitive drum after the toner has been transferred onto the paper.

Further, the image forming apparatus includes therein paper trays 36*a*, 36*b* and 36*c* for respectively accommodating sheets of paper different in size from each other therein, a paper conveying path 37 for successively taking out or extracting the paper one by one from the paper trays and feeding it to the transfer belt 35, a plurality of conveying roller pairs 38 respectively opposed to and brought into contact with each other at suitable positions of the paper conveying path 37 and for conveying paper held therebetween, a paper conveying path 39 for feeding paper with a toner image transferred thereon, a pair of fixing rollers 40 for fixing a toner image on a sheet of paper, etc.

In the image forming apparatus, the paper feeder 10 according to the present invention is disposed in a position on the upstream side of the transfer belt 35 extending in a paper feeding direction and where each paper can be supplied to the transfer belt 35.

In the image forming apparatus referred to above, the sheets of paper are successively extracted one by one from the paper trays 36 that accommodate sheets of paper having selected sizes therein. Further, the extracted paper is conveyed in a predetermined direction along the paper conveying path 37 so as to be fed out to the transfer belt 35 in predetermined timing by the paper feeder 10. Next, the toner images on the photosensitive drums 30 are transferred onto the paper by the corresponding transfer devices 33 so that the toner images having four colors are superposed on one another under the motion of the transfer belt 35. Thereafter, the toner images on the paper are fixed by the pair of fixing rollers 40 and the paper is discharged into the outside of the image forming apparatus.

The paper feeder 10 applied to the image forming apparatus will now be described in detail.

The paper feeder 10 is constructed in such a manner that a paper conveying path 7 is shaped in bent form as shown in FIG. 1. The paper feeder 10 includes therein a resist roller pair 1 opposed to and brought into contact with each other on the upstream side of the transfer belt 35 extending in the paper feeding direction, a paper sensor 8 for detecting the arrival of a leading end portion of each paper in the neighborhood of the resist roller pair 1, a fixed guide member 3 provided on the concave side of the paper conveying path 7 bent on the upstream side of the resist roller pair 1, a movable guide member 4 provided so as to be opposed to and separated from the fixed guide member 3 on the convex side of the paper conveying path 7, and a conveying roller pair 2 for feeding out the paper on the upstream side of the fixed guide member 3 and the movable guide member 4. Further, the paper feeder 10 has a rotatable shaft 5 for rotatably supporting the movable guide member 4 in the neighborhood of an end of the movable guide member 4, which is provided on the upstream side as seen in the paper conveying direction, a film-like elastic member 6 which extends from a leading end portion of the movable guide member 4 to the downstream side as seen in the paper conveying direction, and a torsion spring 9 for urging the movable guide member 4 toward the fixed guide member 3.

The resist roller pair 1 makes it possible to feed out the paper when it is rotatably driven. The timing for rotatably driving the resist roller pair 1 is set so that the paper can be successively and suitably fed out to the transfer belt 35. Namely, when the resist roller pair 1 has stopped rotating, the resist roller pair 1 brings the leading end portion of the paper fed along the paper conveying path 7 into contact with a nip 1*a* so as to temporarily stop rotating. Next, the resist roller pair 1 starts to rotatably drive in predetermined timing so that the movement of the paper is resumed.

The resist roller pair 1 and the conveying roller pair 2 are disposed so that the paper feeding direction of the conveying roller pair 2 and the direction in which the paper enters the resist roller pair 1 respectively have suitable angles. Each of the angles may preferably range from 80° to 130°. However, the angle is set to 120° in the present embodiment.

The conveying roller pair 2 is set so as to stop rotating in the predetermined timing after the leading end portion of the paper has been brought into contact with the nip 1*a* between the resist roller pair 1. Further, the conveying roller pair 2 can change a time interval from the start of its rotation to its stop according to the type of paper. In the present embodiment, when a card board other than a sheet of plain paper is used, the above time interval is set to a time interval slightly longer than that.

The movable guide member 4 is formed between the resist roller pair 1 and the conveying roller pair 2 so as to have a radius of curvature of 30 mm or more. The movable guide member 4 is rotatably supported by the rotatable shaft 5 with the rotatable shaft 5 provided on the upstream side as the center. A portion of the movable guide member 4, which is provided on the downstream side, can be withdrawn from a position opposed to the fixed guide member 3. The movable guide member 4 is urged toward the fixed guide member 3 under a suitable urging force by providing the torsion spring 9 around the rotatable shaft 5 and causing one end 9*a* and the other end 9*b* to engage a housing 41 and the movable guide member 4 respectively.

The film-like elastic member 6 is mounted on the leading end portion of the movable guide member 4 over substantially the entire length of the movable guide member 4, which extends in its transverse direction. Further, the film-like elastic member 6 is formed of a material which is flexibly deformable when it is brought into contact with a bent surface of the paper.

Figure 3:
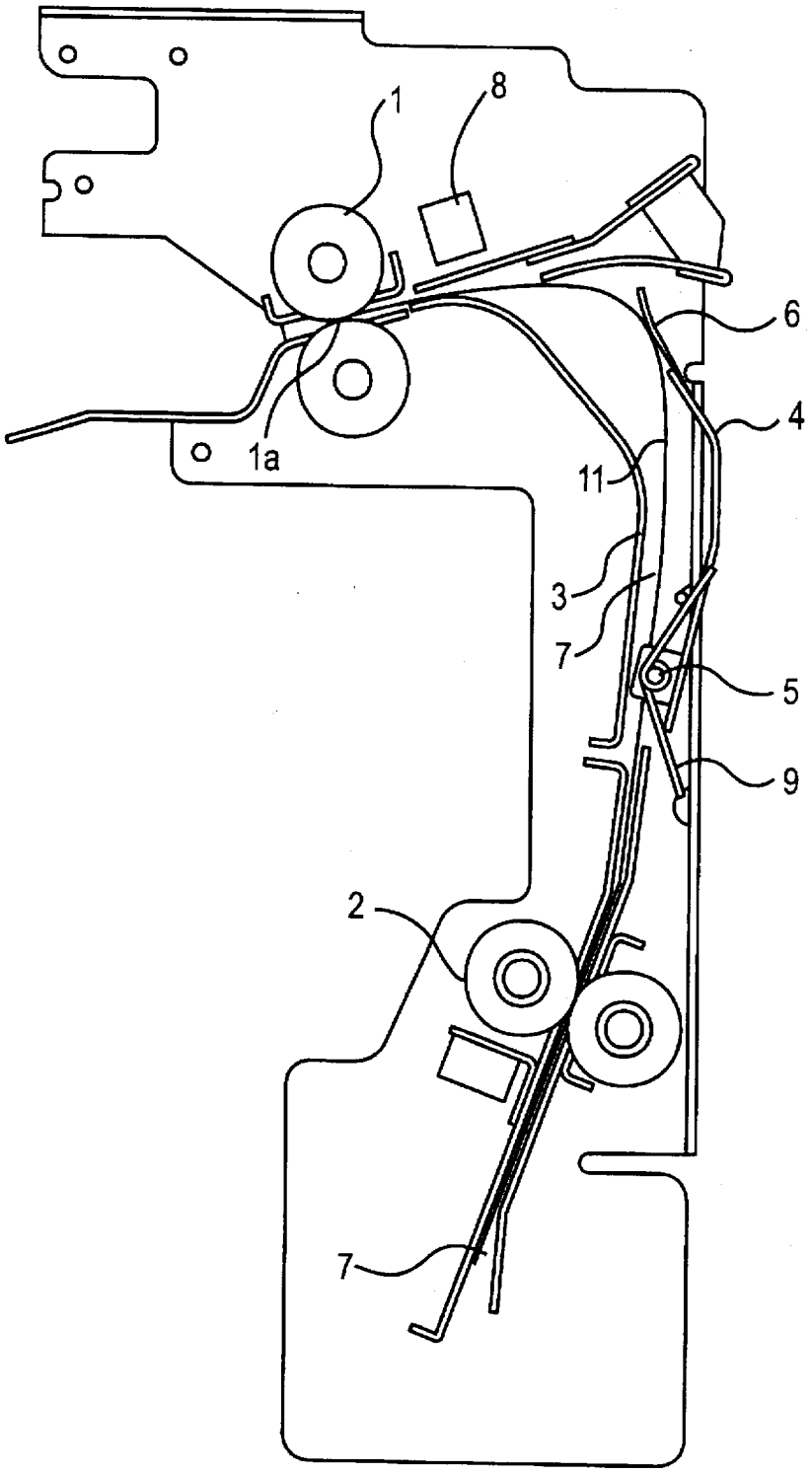
FIG. 3 is a schematic view for describing the operation of the paper feeder shown in FIG. 1.

FIG. 3 is a view for describing the operation of the paper feeder 10.

In the paper feeder 10, a sheet of paper 11 carried in the paper conveying path 7 is fed by the rotation of the conveying roller pair 2 and is bent along the paper conveying path 7 between the movable guide member 4 and the fixed guide member 3. Further, the leading end portion of the paper 11 reaches the nip 1*a* between the resist roller pair 1 under the rotation of the conveying roller pair 2 and is detected by the paper sensor 8. Since, at this time, the resist roller pair 1 stops rotating and the conveying roller pair 2 continues rotating, the paper 11 is deflected toward the movable guide member 4. Therefore, the movable guide member 4 is pressed by a force that extends to the convex surface of the bent paper 11 so that the movable guide member 4 is withdrawn from the position opposed to the fixed guide member 3. After a predetermined time has elapsed since the leading end portion of the paper has been sensed by the paper sensor 8, the conveying roller pair 2 stops rotating. Thus, as shown in FIG. 3, the paper is fed extra by 10 mm or so as compared with the length of the paper conveying path 7 between the resist roller pair 1 and the conveying roller pair 2 so that a loop of the paper is formed on the upstream side of the resist roller pair 1.

The movable guide member 4 is urged toward the fixed guide member 3 by the torsion spring 9 so that a force in the direction of pressing the convex surface of the paper acts on the paper by the movable guide member 4. Therefore, the leading end portion of the paper is pressed against the nip 1*a* between the resist roller pair 1. Thus, even if the leading end portion of the paper makes oblique contact with the nip 1*a*, the direction of the paper can be corrected.

Further, when the convex surface of the bent paper is brought into contact with the film-like elastic member 6 as shown in FIG. 3, the film-like elastic member 6 is flexibly deformed so that the neighborhood of the leading end portion of the paper is withdrawn from the position opposed to the fixed guide member 4. Therefore, the contact surface of the paper is directed to the nip 1*a* between the resist roller pair 1 so that the paper is effectively forced out with a sufficient amount of deflection held on the downstream side of the paper. Thus, the paper can be reliably corrected in a suitable direction even if the paper is obliquely fed.

Thereafter, the resist roller pair 1 is rotatably driven in predetermined timing, so that the paper is fed out by the resist roller pair 1 so as to be delivered to the transfer belt 35. It is thus possible to convey the paper whose direction has been suitably corrected, to the transfer unit and to prevent a displacement in the transfer position.

In the aforementioned paper feeder, the time interval from the time when the leading end portion of the paper is brought into contact with the nip 1*a* between the resist roller pair 1 to the time when the conveying roller pair 1 stops rotating, is set so as to be changed according to the type of paper. It is also possible to produce the amount of deflection that corresponds to or matches the paper. Therefore, since the amount of movement of the movable guide member 4 changes and the amount of deformation of the torsion spring 9 varies according to the amount of its movement, the force for pressing the leading end portion of the paper against the nip 1*a* between the resist roller pair 1 is changed. When a sheet of plain paper of 60 gsm to 90 gsm, for example, is used, the amount of deflection thereof is set to about 10 mm and the force pressed against the nip 1*a* is set to 4.9 (N). On the other hand, when a cardboard of 90 gsm to 120 gsm is used, the amount of deflection thereof is set to about 15 mm and the force pressed against the nip 1*a* can be set to 7.8 (N).

Thus, the force pressed against the registration device can be simply changed by varying the amount of deflection of the paper according to the type of paper. Further, the direction of the paper can be reliably corrected regardless of the type of paper.

The amount of deflection of the paper is changed in the present embodiment. However, the torsion spring may be forcibly deformed by a motor or the like under a fixed amount of deflection to change a repulsive force of the torsion spring.

Figure 4:
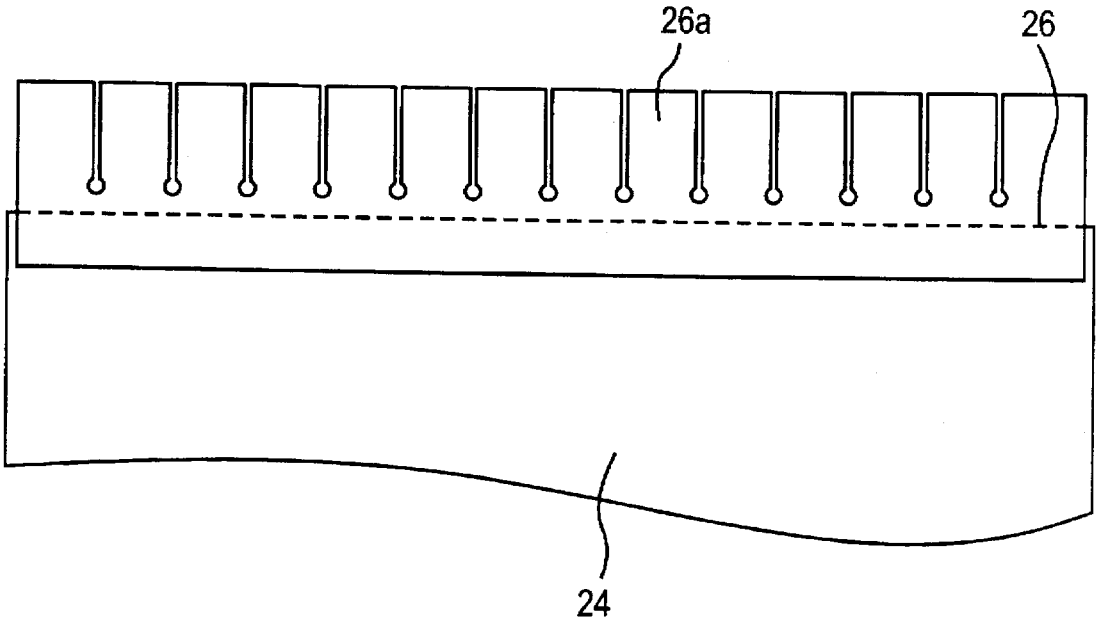
FIG. 4 is a schematic view illustrating a movable guide member and a film-like elastic member both employed in the paper feeder shown in FIG. 1.

FIG. 4 is a schematic view showing the structure of each of the movable guide member and the film-like elastic member both employed in the paper feeder.

In this type of paper feeder, a film-like elastic member 26, which extends from a leading end portion of a movable guide member 24 to the downstream side extending in a paper feeding direction and whose leading end portion is divided into a plurality of parts by cutting plane lines extending in the paper feeding direction, is provided as an alternative to the film-like elastic member 6 disposed in the paper feeder shown in FIG. 1. The film-like elastic member 26 is divided from the neighborhood of the base thereof supported by the movable guide member 24 and has the divided parts 26*a* each having a substantially uniform width as seen in the transverse direction thereof.

The material of the film-like elastic member 26 and the length thereof extending in the paper feeding direction are the same as those of the film-like elastic member 6 shown in FIG. 1. Further, other structure of the paper feeder is identical to that of the paper feeder shown in FIG. 1.

In the paper feeder referred to above, even if the amount of deflection of the paper varies in transverse direction when the paper is obliquely fed, the transversely-divided parts of elastic member are respectively independently brought into contact with the paper so that the urging force is transferred to the paper. Thus, the bent paper is forced out in the direction of the nip between the resist roller pair by the force that is substantially uniformly distributed in the transverse direction, thereby making it possible to reliably correct the diagonal feeding of the paper.

According to the paper feeder, as has been described above, the force in the direction of pressing the bent surface of the paper acts on the paper from the movable guide member. Further, the paper is forced out toward the registration device under the deformation of the film-like elastic member. Therefore, even when the paper is diagonally fed, the direction of the paper can be reliably corrected in the suitable direction. The distribution of the amount of deflection of the paper is brought into a suitable shape by the displacement of the movable guide member and the deformation of the film-like elastic member, thereby making it possible to reliably correct the diagonal feeding of the paper.

Further, the force for pressing the paper against the registration device can be simply changed according to the type of paper and the oblique feeding of the paper can be reliably corrected regardless of the type of paper.

According to the paper feeder, even if the amount of deflection of the diagonally-fed paper varies in transverse direction, the urging force can be transferred to the paper by the film-like elastic member in substantially uniform form as seen in the transverse direction, thereby making it possible to reliably correct the oblique feeding of the paper.

Having now fully described the invention, it will be apparent to those skilled in the art that many changes and modifications can be made without departing from the spirit or scope of the invention as set forth herein.

What is claimed is:

1. A paper feeder comprising:

a pair of guide members provided on both sides of a paper conveying path so as to be opposed to and separated from each other, said pair of guide members positioned for controlling said paper conveying path;

a pair of conveying rollers having an upstream side and a downstream side and opposed to and brought into contact with each other within said paper conveying path, said pairs of conveying rollers rotatably feeding a sheet of paper held therebetween;

a registration device provided on the downstream side of said pair of conveying rollers in said paper conveying path for bringing a leading end portion of the paper into contact with said registration device so as to temporarily stop movement of the leading end portion of the paper in predetermined timing;

wherein said pair of conveying rollers and said registration device being are positioned such that there are at least two bends in the paper conveying path between the downstream side of said pair of conveying rollers and the registration device;

and further wherein said pair of guide members comprises a fixed guide member positioned at the bends of said paper conveying path;

a movable guide member having an upstream end and a downstream end positioned opposed to and separated from said fixed guide member, said movable guide member being rotatably supported on the upstream end of said movable guide member so as to be withdrawable from the position opposed to said fixed guide member;

urging means for urging said movable guide member toward said fixed guide member; and a film-like elastic member which extends from the upstream end of said movable guide member to the downstream end of said movable guide member.

2. The paper feeder as claimed in claim 1, wherein said film-like elastic member is constructed such that at least a leading end portion of said film-like elastic member is divided into a plurality of parts by cutting plane lines extending parallel to paper conveying path.

3. The paper feeder as claimed in claim 1, wherein each said bend has an upstream side and a downstream side, the upstream and downstream side of each bend, when extended, intersecting at an angle preferably in a range of from 80° to 130°.

4. The paper feeder as claimed in claim 2, wherein said film-like elastic member is mounted on the downstream end portion of said movable guide member so as to extend over the substantially entire length of said movable guide member and is formed of a flexibly deformable material.

* * * * *